US006130393A

United States Patent [19]

Chu

[11] Patent Number: 6,130,393

[45] Date of Patent: Oct. 10, 2000

[54] ELECTRICAL ROCKER SWITCH

[75] Inventor: Raymond Wai Hang Chu, Chai Wan, The Hong Kong Special Administrative Region of the People's Republic of China

[73] Assignee: Defond Manufacturing Ltd., Chai Wan, The Hong Kong Special Administrative Region of the People's Republic of China

[21] Appl. No.: 09/339,196

[22] Filed: Jun. 24, 1999

[51] Int. Cl.[7] ..... H01H 21/00

[52] U.S. Cl. ..... 200/556; 200/573; 200/339

[58] Field of Search ..... 200/6 R–6 C, 200/553–559, 573, 574, 339

[56] References Cited

U.S. PATENT DOCUMENTS 4,429,200 1/1984 Glenn et al. ..... 200/153 T
5,270,506 12/1993 Masoner ..... 200/468
5,504,286 4/1996 Tsai ..... 200/5 R
5,601,183 2/1997 Boyd et al. ..... 200/553
5,803,243 9/1998 Nestor et al. ..... 200/556

*Primary Examiner*—Michael Friedhofer
*Attorney, Agent, or Firm*—Leydig, Voit & Mayer

[57] ABSTRACT

An electrical rocker switch includes a body having at least two switch terminals, an internal switching mechanism for momentarily making or breaking an electrical connection between the terminals, an actuating knob on the body for operating the switching mechanism, a rocker supported on the body for pivotal movement between a first position depressing the actuating knob relative to the body and a second position releasing the actuating knob, and a resiliently biassed member for maintaining the rocker in the first and second positions.

19 Claims, 3 Drawing Sheets

100

ELECTRICAL ROCKER SWITCH

The present invention relates to an electrical rocker switch.

BACKGROUND OF THE INVENTION

Electrical rocker switches are of course, known, but they are usually bulky and their stroke of operation is usually long. Switches like micro switches are usually small and their stroke of operation is usually short, but they do not come with a rocker for operation.

The invention seeks to provide an improved electrical rocker switch which has the aforesaid advantages.

SUMMARY OF THE INVENTION

According to the invention, there is provided an electrical rocker switch comprising a body having at least two switch terminals, an internal switching mechanism for momentarily making or breaking electrical connection between the terminals, a press knob provided on the body for operating the switching mechanism, a rocker supported on the body for pivotal movement between a first position depressing the press knob and a second position releasing the press knob, and a resiliently biassed member for maintaining the rocker in either one of the first and second positions.

Preferably, the switching mechanism is a mono-stable switching mechanism as used in a micro switch.

More preferably, one of the terminals is normally-open or normally-closed.

In a preferred embodiment, the resiliently biassed member is provided on the bracket, bearing against an inner surface of the rocker.

More preferably, the resiliently biassed member is spring-loaded and has a round outer surface for selectively engaging with respective recesses formed on the inner surface of the rocker corresponding to the first and second positions of the rocker.

Further more preferably, the resiliently biassed member is in the form of a ball provided at an open end of a tube extending from the bracket, said tube containing a coil spring for urging the ball outwards.

It is preferred that the rocker has opposite ends and is pivotable about a central position, with its inner surface being provided at one of the two ends.

It is preferred that the rocker has opposite ends and is pivotable about a central position, with one of its two ends engageable with the press knob.

In a specific construction, the rocker is supported by a substantially U-shaped bracket on the body, said bracket having a part secured to a side of the body.

More specifically, the bracket has two said parts on opposite sides encompassing the body.

In a preferred embodiment, the electrical rocker switch comprises two said bodies secured together side-by-side, each of which has said at least two switch terminals, a said internal switching mechanism and a said press knob, and includes a single said rocker for depressing and releasing the press knobs and a single said resiliently biassed member.

More preferably, the two bodies are secured together in a mutually reversed manner side-by-side to have their press knobs at opposite ends for operation by respective opposite ends of the rocker.

Further more preferably, the rocker is pivotable to the first position depressing one of the press knobs, the second position depressing the other press knob, and an intermediate position releasing both press knobs.

Specifically, the rocker is supported by a substantially U-shaped bracket on the body, said bracket having a central part clamped between the two bodies.

BRIEF DESCRIPTION OF DRAWINGS

The invention will now be more particularly described, by way of example only, with reference to the accompanying drawings, in which.

DETAILED DESCRIPTION OF PREFERRED EMBODIMENT

Figure 3:
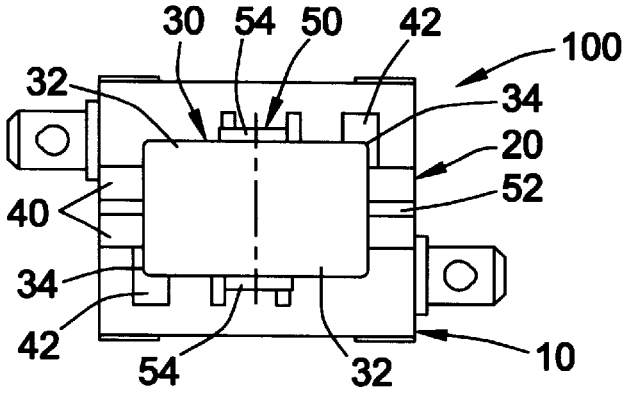
FIGS. 1, 2, 3, and 4 are respective front, end, top and bottom views of a first embodiment of an electrical rocker switch in accordance with the invention.
Figure 1:
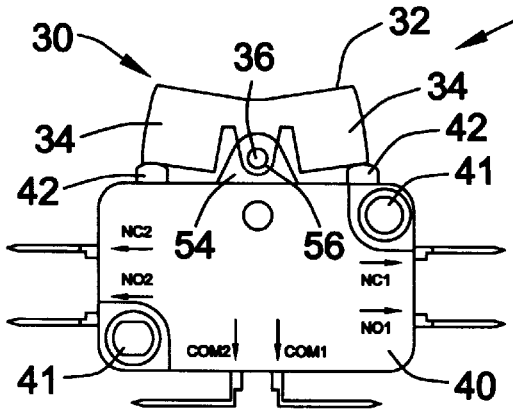
Figure 2:
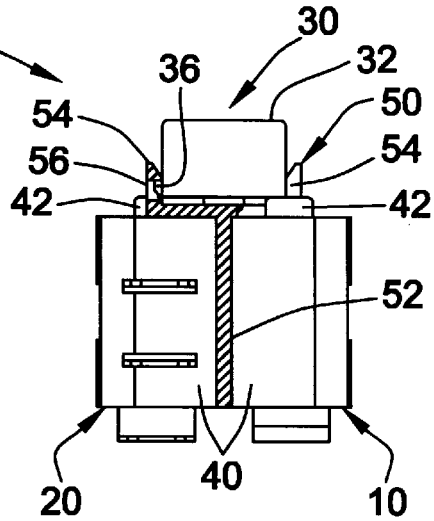
Figure 4:
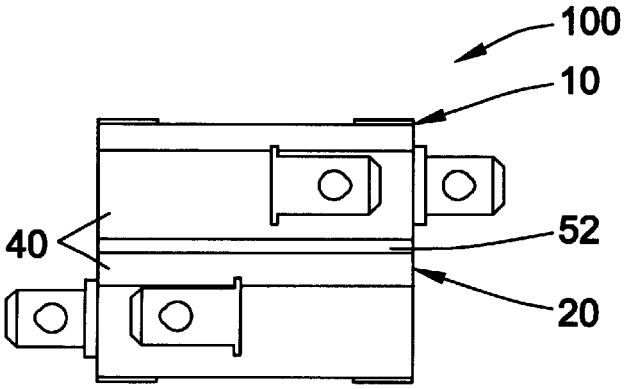
Figure 5:
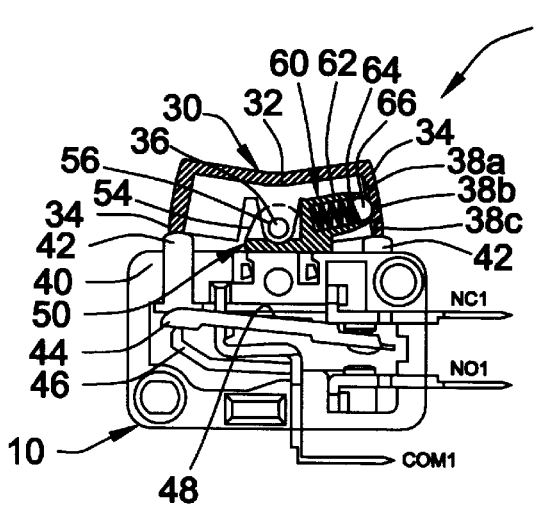
FIGS. 5 and 6 are cross-sectional views corresponding to FIG. 1, showing front and rear parts of the switch, respectively, and a common rocker in a level position.
Figure 6:
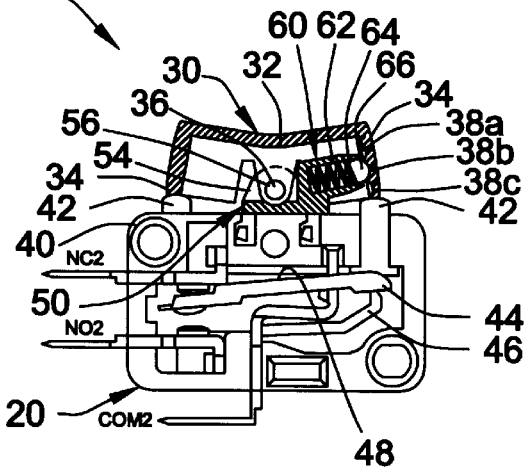
Figure 7:
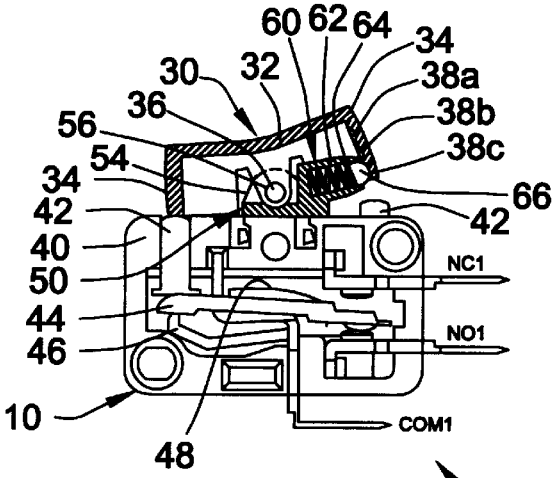
FIG. 7 is a cross-sectional view corresponding to FIG. 5, showing the front part of the switch with the rocker in a left inclined position.

Referring firstly to FIGS. 1 to 8 of the drawings, there is shown a first electrical rocker switch 100 embodying the invention, which switch 100 is formed by a pair of identical front and rear micro switches 10 and 20 and a single rocker 30 for operation. Each micro switch has an individual body 40 and a press knob 42 i.e., actuator, on the top side of the body 40 for operation. It includes a common terminal COM1/COM2 on the bottom side of the body 40 and a pair of normally-closed upper terminals NC1/NC2 and normally-open lower terminal NO1/NO2 on respective sides of the body 40.

A mono-stable switching mechanism is provided inside the switch body 40 for momentarily making and/or breaking electrical connection between the lower terminal NO1/NO2 and/or the upper terminal NC1/NC2 and the corresponding common terminal COM1/COM2. The switching mechanism includes a movable contact lever 44 in electrical connection to the common terminal. COM1/COM2 for making contact with either one of the upper and lower terminals NC1/NC2 and NO1/NO2. The contact lever 44 is resiliently biassed upwards by means of a spring arm 46 normally in contact with upper terminal NC1/NC2. The press knob 42 is in engagement with the contact lever 44 such that, upon depression, knob 42 pushes the contact lever 44 downwards against the action of the spring arm 46 to come into contact with the lower terminal NO1/NO2 instead. The contact lever 44 is provided with a centre-crossing leaf spring 48 arranged to flip the contact lever 44 upwards or downwards according to the direction the contact lever 44 is moving, thereby causing a rapid switchover movement of the contact lever 44 between the upper and the lower terminals NC1/NC2 and NO1/NO2.

The construction and operation of the micro switches 10 and 20 are generally known in the art, with either press knob 42 having a short stroke of operation.

The micro switches 10 and 20 are secured in a mutually reversed manner side-by-side together by any suitable means, such as a pair of rivets passing through opposite corner holes 41 of the switch bodies 40, such that their press knobs 42 are at opposite ends. The rocker 30 is supported centrally on the switch bodies 40 by means of a generally U-shaped bracket 50 having a depending centre plate 52 clamped between the switch bodies 40. Opposite side plates 54 of the bracket 50 are formed centrally with a pair of aligned holes 56.

The bracket 50 includes, at its right end, a spring-loaded unit 60. The unit 60 is formed by a tube 62 extending integrally at a small angle from the bracket end, a coil spring 64 contained inside the tube 62, and a ball 66 provided at a-free open end of the tube 62. The ball 66 is urged by the spring 64 to protrude partially out of the tube end and present a round outer surface.

The rocker 30 has an oblong hollow body 32 having opposite ends 34 and a pair of opposite central side pegs 36. The rocker 30 is supported by the bracket 50 for pivotal movement about a central position, with its side pegs 36 engaging with respective holes 56 of the bracket 50. While in place, the rocker body 32 has its right end half enclosing the spring-loaded unit 60 of the bracket 50 and its opposite ends 34 reaching and thus engageable with the press knobs 42 of the respective micro switches 10 and 20.

Figure 8:
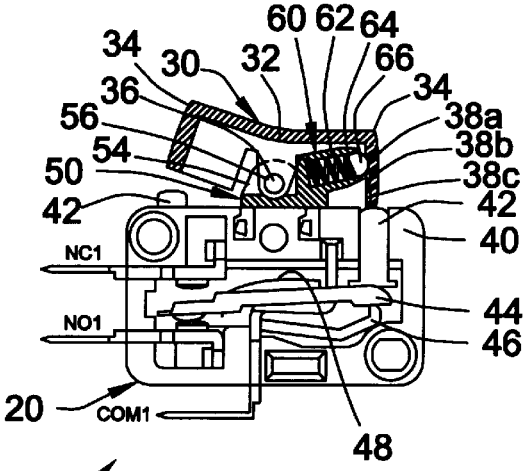
FIG. 8 is a cross-sectional view corresponding to FIG. 6, showing the rear part of the switch with the rocker in a right inclined position.

A series of three round recesses 38A, 38B and 38C are formed on the inner surface of the right end 34 of the rocker body 32 for selective engagement by the ball 66 of the spring-loaded unit 60 in order to maintain the rocker 30 at certain angular positions. The rocker 30 is designed to have three stable angular positions corresponding to the recesses 38B, 38C and 38A, namely an intermediate or level position (FIGS. 5 and 6), a left inclined position (FIG. 7) and a right inclined position (FIG. 8).

In the level position, the opposite ends 34 of the rocker 30 simply touch the respective press knobs 42, without operating the micro switches 10 and 20 such that their upper terminals NC1/NC2 remain connected to the respective common terminals COM1/COM2. In the left inclined position, the rocker 30 operates the front micro switch 10 only, by depressing its press knob 42 and thus switching the common terminal COM1 to the lower terminal NO1. In the right inclined position, the rocker 30 operates the rear micro switch 10 instead, by depressing its press knob 42 and thus switching the common terminal COM2 to the lower terminal NO2.

Figure 9:
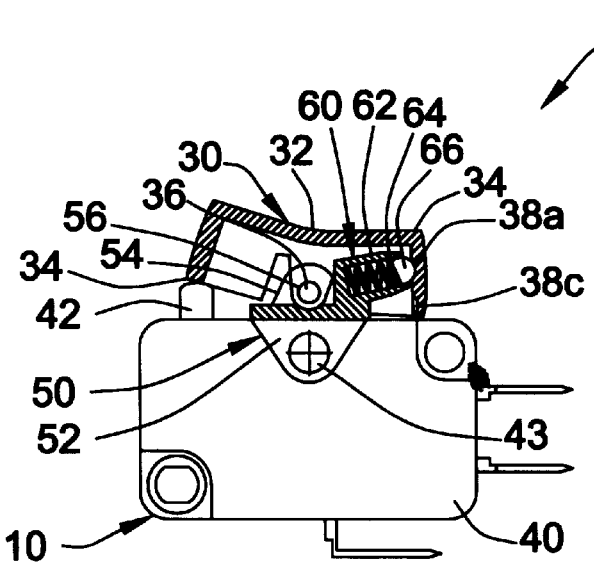
FIGS. 9 and 10 are front views of a second embodiment of an electrical rocker switch in accordance with the invention, showing a rocker in opposite inclined positions.
Figure 11:
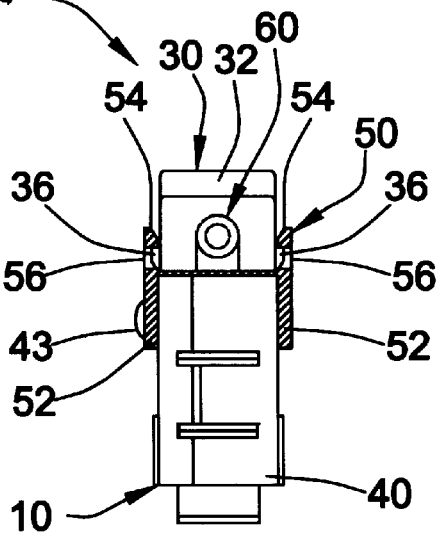
FIG. 11 is an end view of the switch of FIGS. 9 and 10.
Figure 10:
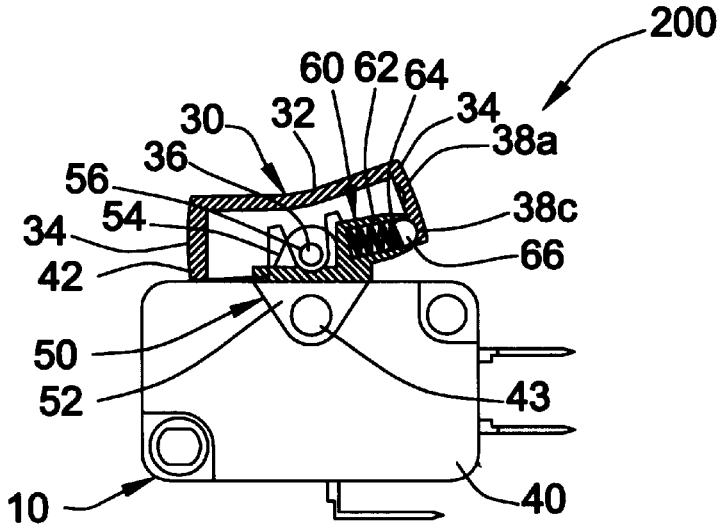

Reference is now made to FIGS. 9 to 11 of the drawings, showing a second electrical rocker switch 200 embodying the invention. This rocker switch 200 is similar to the previous rocker switch 100, with equivalent parts designated by the same reference numerals. The only major difference lies in the use of a single micro switch 10, which necessitates certain modifications to the rocker 30 and the bracket 50.

For the rocker 30, only the two recesses 38A and 38C are provided for selective engagement with the spring-loaded ball 66 to define two stable positions for the rocker 30. These positions are a right inclined position for releasing the press knob 42 (FIG. 9) and a left inclined position for depressing the press knob 42 (FIG. 10).

The bracket 50 remains generally U-shaped, but its depending central plate 52 is replaced by a pair of depending plates 52 on opposite sides for encompassing or riding on the switch body 40. A rivet 43 is used to secure the bracket 50 on the switch body 40 by passing through the side plates 52 and the body 40.

It is envisaged that more than two of the micro switches 10/20 may be combined together for operation by a single rocker 30.

The invention has been given by way of example only, and various other modifications of and/or alterations to the described embodiments may be made by persons skilled in the art without departing from the scope of the invention as specified in the appended claims.

What is claimed is:

1. An electrical rocker switch comprising:

a body having at least two switch terminals;

an internal switching mechanism for momentarily making or breaking an electrical connection between the terminals;

an actuating knob on the body for operating the switching mechanism;

a rocker supported on the body for pivotal movement between a first position depressing, relative to the body, the actuating knob and a second position releasing the actuating knob; and a resiliently biassed member for maintaining the rocker in the first and second positions, wherein the resiliently biassed member is located on a bracket, bearing against an inner surface of the rocker.

2. The electrical rocker switch as claimed in claim 1, wherein the switching mechanism is a mono-stable switching mechanism.

3. The electrical rocker switch as claimed in claim 2, wherein one of the switch terminals is in one of a normally-open and a normally-closed condition.

4. The electrical rocker switch as claimed in claim 1, wherein the resiliently biassed member is spring-loaded and has a round outer surface for selectively engaging respective recesses in the inner surface of the rocker corresponding to the first and second positions of the rocker.

5. The electrical rocker switch as claimed in claim 4, wherein the resiliently biassed member includes a tube, a coil spring in the tube, and a ball at an open end of the tube, the tube extending from the bracket and the coil spring for urging the ball outward.

6. The electrical rocker switch as claimed in claim 1, wherein the rocker has opposite ends and is pivotable about a central position, with the inner surface being located at one of the two ends.

7. The electrical rocker switch as claimed in claim 1, wherein the rocker has opposite ends and is pivotable about a central position, with one of the ends engaging the actuating knob.

8. An electrical rocker switch comprising:

a body having at least two switch terminals;

an internal switching mechanism for momentarily making or breaking an electrical connection between the terminals;

an actuating knob on the body for operating the switching mechanism;

a rocker supported on the body for pivotal movement between a first position depressing, relative to the body, the actuating knob and a second position releasing the actuating knob; and a resiliently biassed member for maintaining the rocker in the first and second positions, wherein the rocker is supported by a substantially U-shaped bracket on the body, the bracket having a part secured to a side of the body.

9. The electrical rocker switch as claimed in claim 8, wherein the bracket has parts on opposite sides of the body.

10. The electrical rocker switch as claimed in claim 8, wherein the switching mechanism is a mono-stable switching mechanism.

11. The electrical rocker switch as claimed in claim 10, wherein one of the switch terminals is in one of a normally-open and a normally-closed condition.

12. The electrical rocker switch as claimed in claim 8, wherein the rocker has opposite ends and is pivotable about a central position, with one of the ends engaging the actuating knob.

13. An electrical rocker switch comprising:

first and second bodies secured together side-by-side, each of the first and second bodies having at least two switch terminals, an internal switching mechanism for momentarily making or breaking an electrical connection between the at least two switch terminals, and an actuating knob on the body, for operating the switching mechanism, a single rocker for pivotable movement between a first position depressing, relative to the first and second bodies, at least one of the actuating knobs of the first and second bodies and a second position releasing at least one of the actuating knobs of the first and second bodies; and a single resiliently biassed member.

14. The electrical rocker switch as claimed in claim 13, wherein the first and second bodies are secured together in a mutually reversed manner, side-by-side, with the actuating knobs at opposite ends for operation by respective opposite ends of the rocker.

15. The electrical rocker switch as claimed in claim 14, wherein the rocker is pivotable to the first position, depressing one of the actuating knobs, the second position depressing the other actuating knob, and an intermediate position releasing both actuating knobs.

16. The electrical rocker switch as claimed in claim 14, wherein the rocker is supported by a substantially U-shaped bracket on the first and second bodies, the bracket having a central part clamped between the first and second bodies.

17. The electrical rocker switch as claimed in claim 13, wherein the internal switching mechanisms in the first and second bodies are mono-stable switching mechanisms.

18. The electrical rocker switch as claimed in claim 17, wherein one of the switch terminals in each of the first and second bodies is in one of a normally-open and a normally-closed condition.

19. The electrical rocker switch as claimed in claim 13, wherein the rocker has opposite ends and is pivotable about a central position, with one of the ends engaging one of the actuating knobs.

* * * * *